United States Patent [19]

Wiedmer

[11] Patent Number: 4,530,436

[45] Date of Patent: Jul. 23, 1985

[54] SCREW CAP WITH GUARANTEE STRIP FOR CONTAINER

[76] Inventor: Walter Wiedmer, Am Linthli 2, Näfels, Switzerland

[21] Appl. No.: 668,189

[22] Filed: Nov. 5, 1984

Related U.S. Application Data

[63] Continuation of Ser. No. 442,838, Nov. 18, 1982, abandoned.

[30] Foreign Application Priority Data

Dec. 11, 1981 [CH] Switzerland ..... 7940/81-7

[51] Int. Cl.[3] ..... B65D 41/24

[52] U.S. Cl. ..... 215/246; 215/252

[58] Field of Search ..... 215/246–253, 215/258, 329, DIG. 1

[56] References Cited

U.S. PATENT DOCUMENTS

| | | | |
|---|---|---|---|
| 4,305,516 | 12/1981 | Perne et al. | 215/252 |
| 4,345,692 | 8/1982 | Obrst et al. | 215/252 |
| 4,458,821 | 7/1984 | Ostrowsky | 215/252 |
| 4,458,822 | 7/1984 | Ostrowsky | 215/252 |
| 4,461,390 | 7/1984 | Csaszar | 215/252 |
| 4,479,586 | 10/1984 | Csaszar | 215/258 |
| 4,480,761 | 11/1984 | Aichinger | 215/252 |

*Primary Examiner*—Allan N. Shoap
*Assistant Examiner*—Bryon Gehman

[57] ABSTRACT

Below the closure member 1, the screw cap has a closing band, whose wall thickness is less than that of the closure member. The heat-shrunk guarantee strip is fitted to this closing band by means of webs and a connecting piece. The guarantee strip has an interruption and a predetermined breaking element bridging the latter. Due to the fact that the connecting piece forms a rigid area with the end of the guarantee strip, on unscrewing the cap, under the action of the circumferential forces widening the guarantee strip, firstly the predetermined breaking element and then the adjacent webs tear. The guarantee strip always remains connected to the closure member and does not adhere to the bottle, which would have a disadvantageous effect at the time of reuse.

2 Claims, 2 Drawing Figures

SCREW CAP WITH GUARANTEE STRIP FOR CONTAINER

This application is a continuation of application Ser. No. 442838, filed Nov. 18, 1982 now abandoned.

BACKGROUND OF THE INVENTION

The invention relates to a screw cap for containers, particularly beverage bottles, with a closure member and a circular guarantee strip connected thereto by means of a plurality of webs and by means of a connecting piece and at the time of the first unscrewing of the cap from the closure member, said strip is at least partly separated and at least the guarantee strip is made from heat shrinkable plastic.

Guarantee strips on caps, tops, closures and the like serve to indicate the first unscrewing of the cap or the opening of the container. This is indicated by the fact that the guarantee strip is damaged during the opening process. Generally, there is a clearly visible separation from the actual cap. Such guarantee strips are in particular known in connection with metal screw caps, in which they remain attached to the container neck as a separated ring. However, strips made from paper and plastic have also already been proposed.

The choice of the most suitable type of guarantee strip in the case of containers, depends on the possibilities of reusing the latter. More particularly in the case of bottles, it is a question of whether they are so-called disposable bottles, or whether they are returned to the filling station for reuse. In the latter case, certain important points must be taken into consideration and which result from the rational reuse of such bottles, although they are generally ignored. It is firstly and particularly important that following the initial opening and its separation from the cap, the guarantee strip does not remain attached to the bottle. This is unimportant in the case of disposable bottles, but with bottles which are returned it must be remembered that on return these bottles are cleaned, the label is removed, they are then filled and provided with a new and identical cap. However, the cleaning installations are unable to remove guarantee strips which remain attached. In view of the high hourly capacity of such plants, the fitting of the new cap can lead to serious faults. This is particularly the case when using the caps having guarantee strips made from heat shrinkable plastic.

Heat shrinkable caps for beverage bottles are already known. In the case of such a cap, below the cap body there is merely a thin ring, which is connected to the said body by means of thin webs and a single connecting piece. Although the lower end of the ring extends up to the container neck, its upper edge still remains on the threaded mouth area, whose diameter is somewhat larger than that of the neck. This diameter difference makes it possible to shrink the guarantee strip onto the smaller diameter of the neck, although it initially has a diameter corresponding to that of the mouth area. If shrinkage is inadequate, the lower edge does not correctly engage on the neck and there is a risk that the screw cap can be removed from the bottle without damaging the guarantee ring. However, if more shrinkage heat is applied to the closure, there can be peripheral bonding together of the ring as a result of the disappearance of the inadequate predetermined breaking point due to material flow. However, as a result of this bonding or sealing operation, the ring sticks to the bottle, because it has now become resistant to expansion, leading to the disadvantages referred to hereinbefore.

BRIEF SUMMARY OF THE INVENTION

The problem of the invention is therefore to provide a screw cap made from heat shrinkable plastic and although its guarantee strip tears in a completely satisfactory manner during the first opening process, its remnants remain attached to the closure member and not to the bottle. This ensures that when the bottle is returned to the filling station, it does not carry any annoying strip residues.

According to the invention, such a screw cap is characterized by the features of claim 1.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
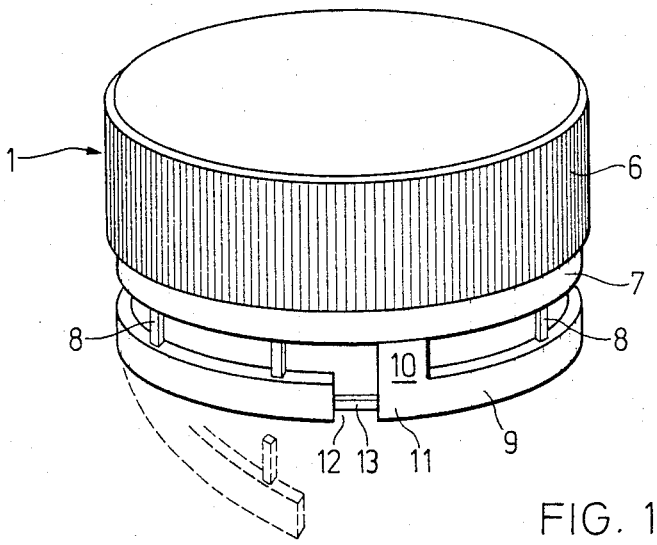
FIG. 1 a perspective view of the cap.
Figure 2:
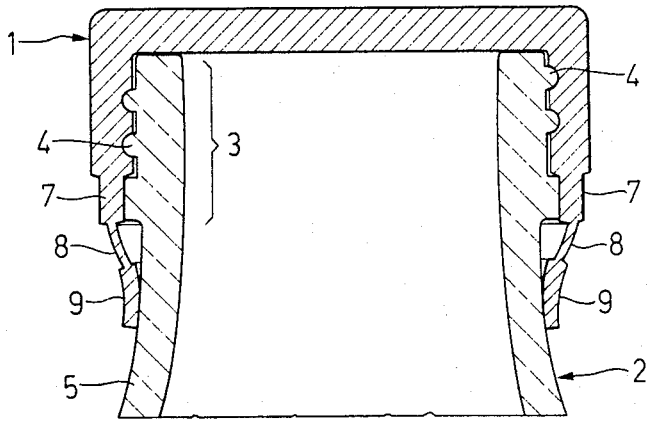
FIG. 2 a cross-section through the fitted cap.

The closure member 1 can have a random construction, especially with respect to a central part (not shown) which engages into the interior of a beverage bottle 2. Bottle 2 has the usual mouth area 3 with an external thread 4, which is followed by the bottle neck 5. Neck 5 has a diameter, which is smaller than that of the mouth area 3 below thread 4.

Below closure member 1, which according to FIG. 1 has a rough surface on its outside, e.g. in the form of a partly indicated milling 6, is provided a closing band 7. As can be seen, this is thinner than the closure member 1. It is connected to the latter over its entire upper edge and is constructed as a continuous ring.

A guarantee strip 9 is connected to the closing band 7 by means of a plurality of thin webs 8 distributed along the circumference. Strip 9 must be made from heat shrinkable material. The remaining parts, namely closure member 1, closing band 7 and webs 8 can in theory be made from a conventional plastic. However, for manufacturing and also price reasons, it is virtually impossible to use different plastics, so that the complete cap is made from heat shrinkable material. However, closure member 1 has a thick wall and therefore withstands the short heat treatment, with virtually no shape change. Thus, there is no need to fear a jamming on the outer thread 4 of the bottle preventing its subsequent unscrewing.

Apart from webs 8, there is a connecting piece 10 which, as a strong transition piece, is much wider than webs 8. Connecting piece 10 also has the same thickness as guarantee strip 9, whilst advantageously webs 8 are thinner. As can be seen from FIG. 1, connecting piece 10 can be considered as an angular shoulder on one end 11 of the guarantee strip which is in the form of a split ring. The point at which the ring circumferentially has an interruption 12, is immediately adjacent to connecting piece 10 and is bridged by a predetermined breaking element 13, which can be the same as one of the webs 8.

The advantages of the represented screw cap will now be described. Reference is firstly made to the closing band 7 which, because it is thinner than the closure member 1, can shrink somewhat during the heat treatment. However, as stated hereinbefore, the closure member 1 is too thick to detectably shrink. However, closing band 7 is able to do this and as a result permits a better engagement of guarantee strip 9 on bottle neck 5, so that heating expenditure is less than in the case of the cap according to the prior art. Furthermore, as a result of the closing band, the height of closure member 1 can be reduced, so that material is saved. Although in the case of a single cap, this material saving is small, in view of the large numbers of such caps produced, the saving is noteworthy.

Importance is also attached to the position of connecting piece 10 immediately adjacent to interruption 12, as well as to the latter, together with the predetermined breaking element 13. Due to the fact that after heat shrinkage, the guarantee strip has a smaller diameter than mouth area 3, on screwing down the cap it must be expanded to the diameter of the mouth area. Connecting piece 10 now reinforces end 11 of the guarantee strip in such a way that an area is formed, which withstands the circumferential forces occurring during expansion. Thus, expansion leads to the immediate break of the predetermined breaking element 13. As a result of this break, the circumferential forces which are still being applied act fully on webs 8, particularly those close to the interruption 12, so that at least three webs also tear. Finally, and as shown by dotted lines in FIG. 1, the guarantee strip hangs sloping downwards without being detached from the closure member 1. In fact, it is removed from the bottle together with member 1, which satisfies the essential requirement set hereinbefore.

What is claimed is:

1. A screw cap for containers, particularly for beverage bottles, comprising:

a closure member having a lower edge;

a closing band having a lower edge and an upper edge which is connected to said closure member lower edge, said closing band having a thickness which is less than the thickness of said closure member;

a plurality of webs connected to said closing band lower edge, said webs being fracturable upon removal of said closure member from a container and being thinner than said closing band;

a continuous, uninterrupted guarantee strip connected to said webs, said guarantee strip having a thickness greater than the thicknesses of each of said webs to be stronger than said webs and having a circumferential length less than the circumference of said closure member whereby the ends of said guarantee strip are spaced apart to define a gap when said guarantee strip is attached to said closure member by said webs;

a breaking element means extending across said gap for connecting said guarantee strip ends together and for breaking upon application of a predetermined amount of force during removal of said closure member from a container to release said guarantee strip ends, said guarantee strip, said webs, and said closing band being heat shrinkable relative to said closure member to bear against the container said guarantee strip being inwardly offset from said closure member and at least a portion of said closing band and said webs, whereby upon breaking of said breaking element means said guarantee strip will tend to be forced outwardly away from the container adjacent to said gap due to release of forces within said heat shrinkable guarantee strip after release of the ends of said guarantee strip by the breaking of said breaking element means; and a connecting piece means for connecting one end of said guarantee strip to said closing band lower edge, said connecting piece means being stronger than said webs and said breaking piece means for ensuring breaking of said breaking piece means and the webs adjacent to said gap upon application of the predetermined amount of force for causing the other end of said guarantee strip to move outwardly away from the container after said breaking piece means is broken.

2. A screw cap according to claim 1, wherein it is made entirely from heat shrinkable plastic.

* * * * *